US008265524B2

(12) United States Patent
Hatayama et al.

(10) Patent No.: US 8,265,524 B2
(45) Date of Patent: Sep. 11, 2012

(54) TRANSFER DEVICE, IMAGE FORMING APPARATUS, AND WASTE TONER CONTAINER

(75) Inventors: Kohji Hatayama, Kanagawa (JP); Tomofumi Inoue, Osaka (JP); Takeshi Sakashita, Osaka (JP); Mitsutoshi Kichise, Osaka (JP); Yuuji Meguro, Ibaraki (JP); Takeru Muramatsu, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 973 days.

(21) Appl. No.: 12/000,054

(22) Filed: Dec. 7, 2007

(65) Prior Publication Data

US 2008/0138133 A1 Jun. 12, 2008

(30) Foreign Application Priority Data

Dec. 8, 2006 (JP) ..... 2006-331414

(51) Int. Cl.
*G03G 15/20* (2006.01)

(52) U.S. Cl. ..... 399/123; 399/358; 399/360

(58) Field of Classification Search ..... 399/360, 399/358, 123, 121
See application file for complete search history.

(56) References Cited

U.S. PATENT DOCUMENTS

| | | | | |
|---|---|---|---|---|
| 2003/0219292 | A1* | 11/2003 | Serizawa et al. | 399/360 |
| 2007/0269233 | A1 | 11/2007 | Sakashita et al. | |
| 2007/0292179 | A1* | 12/2007 | Kudo | 399/358 |
| 2008/0028967 | A1 | 2/2008 | Sakashita et al. | |

FOREIGN PATENT DOCUMENTS

| | | | |
|---|---|---|---|
| JP | 06-130867 | | 5/1994 |
| JP | 2597333 | | 4/1999 |
| JP | 2000019914 | A * | 1/2000 |
| JP | 2000-259053 | | 9/2000 |
| JP | 2001222198 | A * | 8/2001 |
| JP | 2001-318570 | | 11/2001 |
| JP | 2002169440 | A * | 6/2002 |
| JP | 2003-156946 | | 5/2003 |
| JP | 2004117392 | A * | 4/2004 |

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

A transfer device includes a cleaning device, a waste toner bottle, a connecting unit, and a regulating unit. The cleaning device removes waste toner remaining on an intermediate transfer belt. The waste toner bottle has an intake opening for collecting the waste toner therein. The connecting unit conveys the waste toner from the cleaning device to the waste toner bottle, and has a discharge opening that is configured to engage the intake opening to discharge the waste toner into the waste toner bottle through the intake opening. The regulating unit regulates the position of the waste toner bottle in a direction perpendicular to the moving direction of the waste toner bottle before the discharge opening comes in contact with the intake opening.

17 Claims, 6 Drawing Sheets

TRANSFER DEVICE, IMAGE FORMING APPARATUS, AND WASTE TONER CONTAINER

CROSS-REFERENCE TO RELATED APPLICATIONS

The present application claims priority to and incorporates by reference the entire contents of Japanese priority document 2006-331414 filed in Japan on Dec. 8, 2006.

BACKGROUND OF THE INVENTION

1. Field of the Invention

The present invention relates to a transfer device, an image forming apparatus, and a waste toner container.

2. Description of the Related Art

Recent image forming apparatuses generally include an intermediate transfer member to implement a function of forming a full-color image or a multiplexed image.

Such an image forming apparatus also includes a waste toner collecting mechanism to remove residual toner from the intermediate transfer member and collect it as waste toner in a waste toner bottle. The waste toner bottle is detachably attached to the image forming apparatus, and, by replacing the waste toner bottle with new one, waste toner is disposed of. The waste toner bottle need be easily positioned and attached to and detached from the image forming apparatus. It is also necessary to prevent leakage of waste toner from a portion at which the waste toner bottle is attached to the image forming apparatus.

For example, Japanese Patent Application Laid-open No. 2003-156946 discloses a conventional technology in which a waste toner bottle is connected to a cleaner unit by fitting a projecting portion of the cleaner unit into an intake opening of the waste toner bottle held by a waste toner bottle holding member. The projecting portion is provided on one end in the longitudinal direction of the cleaner unit that is fixed to an intermediate transfer unit and has a discharge opening through which waste toner is discharged. In this configuration, the cleaner unit 23 and the waste toner bottle make up-and-down movement in conjunction with the contact/separation movement of the intermediate transfer unit. Besides, the position of the waste toner bottle holding member is determined by an contact/separation unit for the contact/separation movement. Thus, the waste toner bottle holding member makes up-and-down movement while holding the waste toner bottle.

Japanese Registered Utility Model No. 2597333 discloses another conventional technology in which a spring is attached to a waste toner container, and a cap is attached to the end of the spring. In this configuration, when an exterior front cover of the apparatus is closed, the spring is compressed by the exterior front cover through the cap. The waste toner container is biased by the biasing force of the spring, so that the waste toner container is received by a container receiving lever, and is positioned at a predetermined location in the apparatus.

Some waste toner bottles include an agitating plate used for agitating waste toner therein, so that the waste toner bottles can be filled with collected waste toner without wasting the space therein. Such an agitating plate transports waste toner in the waste toner bottle from its intake opening toward the inside of the waste toner bottle. The agitating plate is provided for efficiently using the space of the waste toner bottle. A waste toner bottle having such an agitating plate includes an agitating shaft for driving the agitating plate that extends from the inside to the outside of the waste toner bottle. On an end of the agitating shaft is arranged an agitating gear. When the waste toner bottle is attached to an image forming apparatus, the agitating gear needs to be engaged with a main body gear provided on the main body of the image forming apparatus so that the driving force can be transmitted.

This type of waste toner bottle needs to be attached to the image forming apparatus while being positioned at least two points such as at the agitation gear and at the toner transport path joint with high accuracy. Waste toner can be transported by a screw or by reciprocating movements of an agitating plate provided to an agitating shaft. In any case, it is necessary to attach the waste toner bottle to the image forming apparatus at a plurality of points so that the driving force can be transmitted to the waste toner transporting means.

Thus, there is a need of a technology for positioning a waste toner bottle at a plurality of points, which the conventional technologies do not take into account.

SUMMARY OF THE INVENTION

It is an object of the present invention to at least partially solve the problems in the conventional technology. partially solve the problems in the conventional technology.

According to an aspect of the present invention, a transfer device includes: a transfer unit that includes a transfer member that transfers a toner image onto a transfer-receiving member; a cleaning unit that removes waste toner remaining on the transfer-receiving member; a waste toner container that is configured to be attached to an image forming apparatus, and includes an intake opening through which the waste toner is collected therein; and a connecting member that includes a discharge opening, and is configured to connect between the cleaning unit and the waste toner container to convey the waste toner from the cleaning unit and discharge the waste toner from the discharge opening into the waste toner container through the intake opening. The discharge opening is brought into engagement with the intake opening when the waste toner container is moved toward the connecting member and separates from the intake opening when the waste toner container is moved away from the connecting member. The transfer device further includes a regulating unit that regulates a position of the waste toner container with respect to the image forming apparatus in a direction perpendicular to a moving direction of the waste toner container before the discharge opening comes in contact with the intake opening while the waste toner container is moving toward the connecting member.

According to another aspect of the present invention, an image forming apparatus that includes a transfer device. The transfer device includes: a transfer member that transfers a toner image onto a transfer-receiving member; a cleaning unit that removes waste toner remaining on the transfer-receiving member; a waste toner container that is detachable, and includes an intake opening through which the waste toner is collected therein; and a connecting member that includes a discharge opening, and is configured to connect between the cleaning unit and the waste toner container to convey the waste toner from the cleaning unit and discharge the waste toner from the discharge opening into the waste toner container through the intake opening. The discharge opening is brought into engagement with the intake opening when the waste toner container is moved toward the connecting member and separates from the intake opening when the waste toner container is moved away from the connecting member. The transfer device further includes a regulating unit that regulates a position of the waste toner container in a direction perpendicular to a moving direction of the waste toner container before the discharge opening comes in contact with the intake opening while the waste toner container is moving toward the connecting member.

According to still another aspect of the present invention, a waste toner container that is configured to be detachably attached to an image forming apparatus that includes a transfer member that transfers a toner image onto a transfer-receiving member, a cleaning unit that removes waste toner remaining on the transfer-receiving member, and a connecting member that includes a discharge opening and conveys the waste toner from the cleaning unit. The waste toner container includes: an intake opening that is configured to engage the discharge opening for collecting the waste toner conveyed through the connecting member and discharged from the discharge opening, and that is brought into engagement with the discharge opening when the waste toner container is moved toward the connecting member and separates from the discharge opening when the waste toner container is moved away from the connecting member; and a regulating unit that regulates a position of the waste toner container with respect to the image forming apparatus in a direction perpendicular to a moving direction of the waste toner container before the discharge opening comes in contact with the intake opening while the waste toner container is moving toward the connecting member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
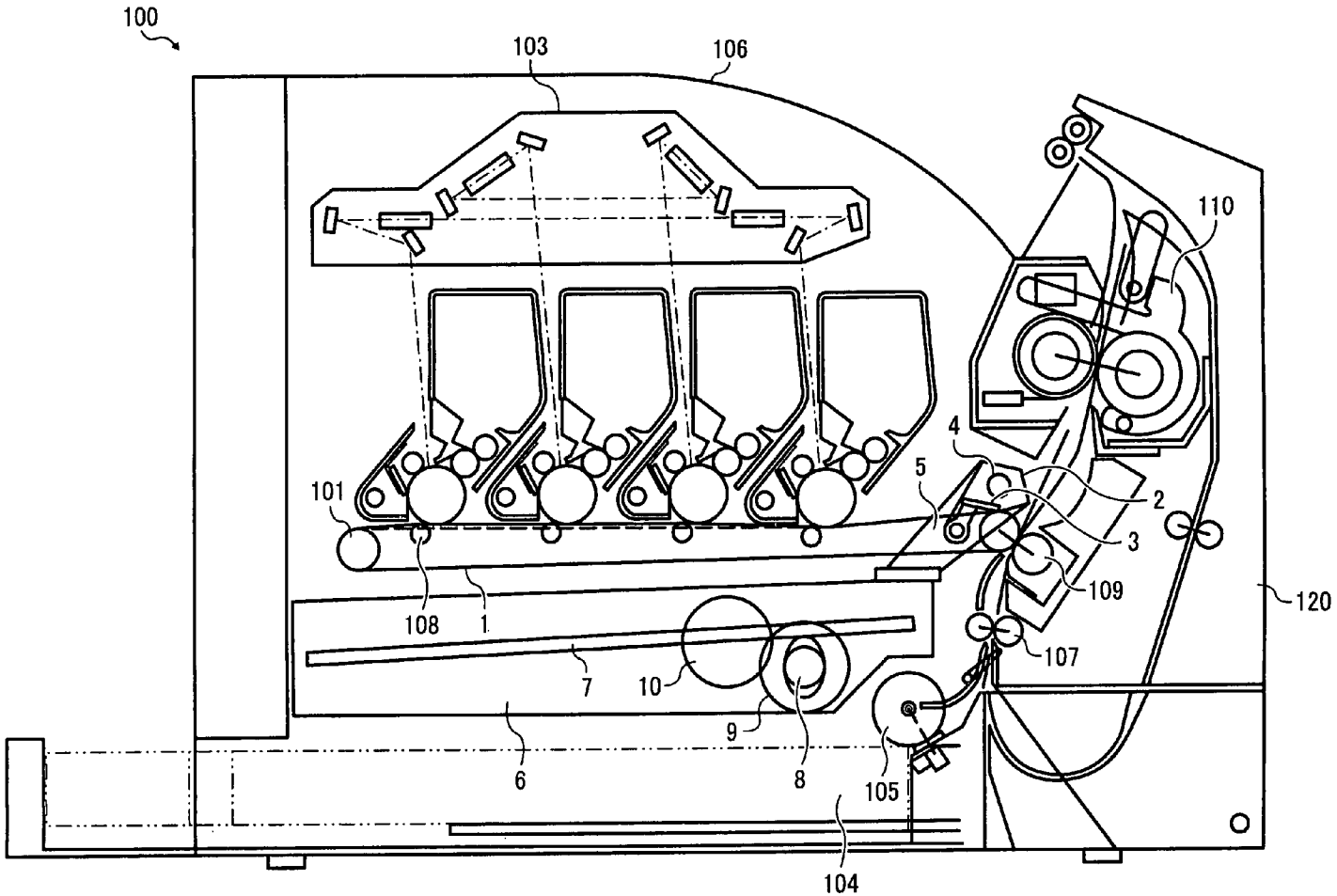
FIG. 1 is a cross-sectional view of an image forming apparatus according to an embodiment of the present invention.

FIG. 1 is a cross-sectional view of an image forming apparatus according to an embodiment of the present invention. The image forming apparatus is explained as, for example, a tandem color image forming apparatus. The image forming apparatus includes a main body 100 and process cartridges 102*a*, 102*b*, 102*c*, and 102*d* each corresponding to one of colors of yellow, cyan, magenta, and black. The process cartridges 102*a*, 102*b*, 102*c*, and 102*d* are detachably attached to the main body 100. The main body 100 includes an exposure device 103, an intermediate transfer unit 101, a sheet-feed tray 104, and a fixing device 110.

A toner image is formed in the process cartridges 102*a*, 102*b*, 102*c*, and 102*d* each set at a predetermined position in the main body 100. A primary transfer bias is applied from a power source (not shown) to primary transfer rollers 108 so that the toner image is primarily transferred electrostatically onto an intermediate transfer belt 1. While rollers are cited as an example of transfer members, the transfer members can be of a form other than a roller such as a brush and a blade. While the process proceeds from the image forming step to the primarily transfer step, a sheet stored in the sheet-feed tray 104 is transported to a pair of registration rollers 107 by a sheet-feed roller 105. the registration rollers 107 adjusts the position of the sheet with respect to the toner image on the intermediate transfer belt 1 at the position of a secondary transfer roller 109. Thus, the toner image is secondarily transferred onto the sheet. Subsequently, the sheet passes through a nip between rollers of the fixing device 110, and is adhered onto the sheet by heat and pressure. Thereafter, the sheet is ejected onto a sheet-eject tray 106 provided outside the image forming apparatus.

A cleaning device 2 is provided to remove waste toner that remains on the intermediate transfer belt 1 after the secondary transfer. The cleaning device 2 includes a cleaning blade 3 that abuts the intermediate transfer belt 1 and a screw 4. The screw 4 transports the waste toner in the axial direction thereof. The waste toner that has been transported to an end of the cleaning device 2 passes through a connecting unit 5 and is collected into a waste toner bottle 6. At the same time, for filling the waste toner bottle 6 with waste toner without wasting any space, an agitating plate 7 that agitates waste toner in the waste toner bottle 6 is driven to make swinging movements. The agitating plate 7 is in contact with an agitating shaft 8 that extends from the inside to the outside of the waste toner bottle 6. The agitating plate 7 engages with an agitating gear 9 assembled onto an end of the agitating shaft 8 and a main body gear 10 provided on the main body 100, and thereby is applied with a driving force to make swinging movements.

Figure 2:
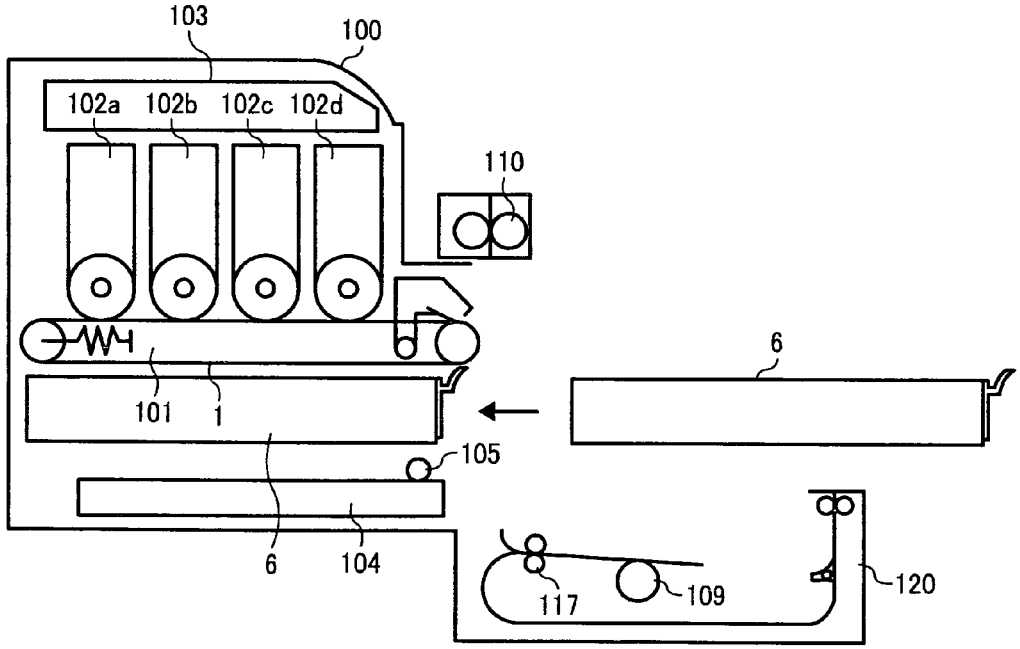
FIG. 2 is a schematic diagram for explaining directions in which a waste toner bottle is attached to and detached from a main body of the image forming apparatus.

FIG. 2 is a schematic diagram for explaining directions in which the waste toner bottle 6 is attached to and detached from the main body 100. As shown in FIG. 2, the waste toner bottle 6 is configured to make what is called "front access", which means it is possible to attach and detach the waste toner bottle 6 to and from the main body 100 from the front side of the main body 100. Shown in FIG. 2 is a state in which a front cover 120 of the main body 100 is open to set the waste toner bottle 6.

Figure 3A:
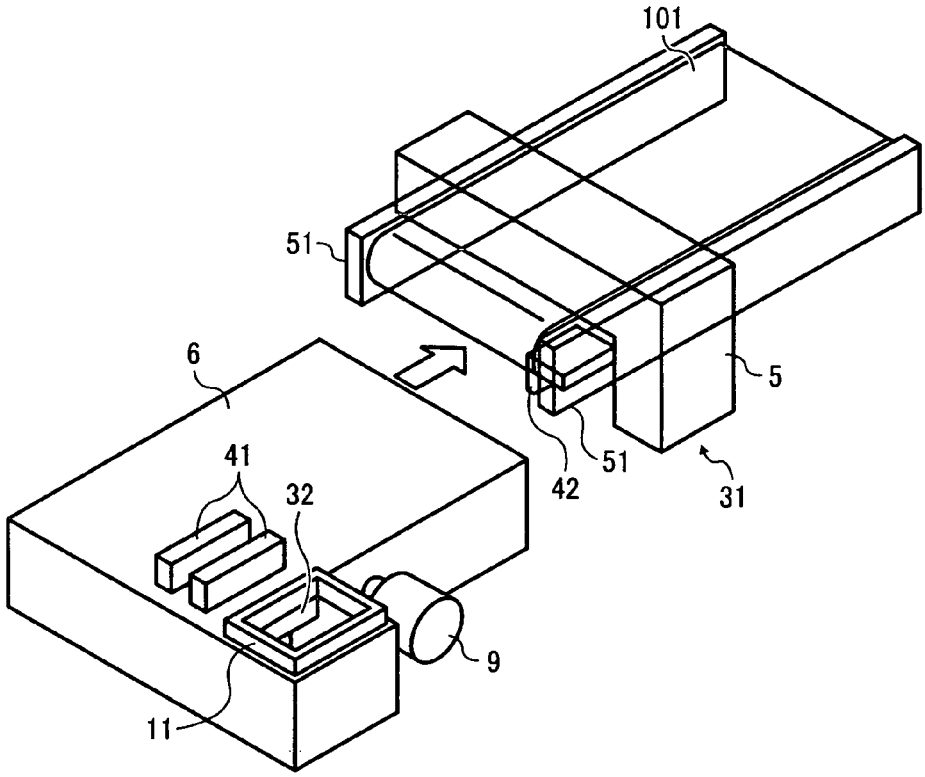
FIGS. 3A and 3B are perspective views of a waste toner bottle attached to an image forming apparatus according to a first embodiment of the present invention.
Figure 3B:
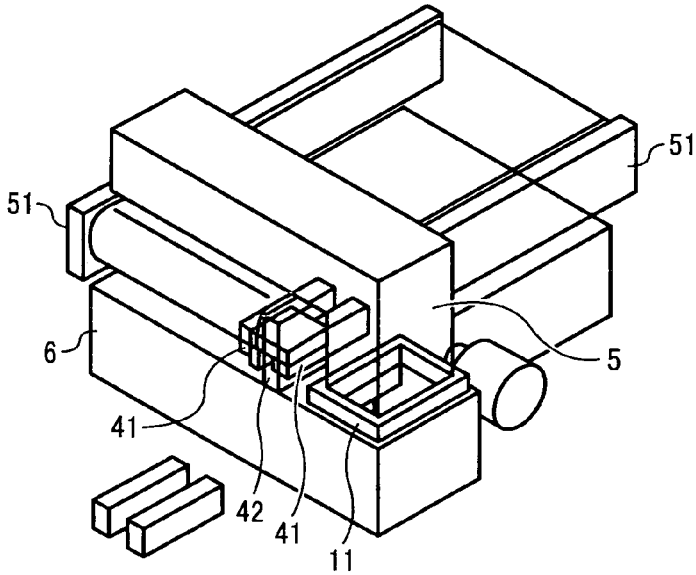

FIGS. 3A and 3B are schematic diagram of an image forming apparatus according to a first embodiment of the present invention. FIG. 3A is a perspective view of the waste toner bottle 6 to be attached to the image forming apparatus. FIG. 3B is a perspective view of the waste toner bottle 6 attached to the image forming apparatus.

The waste toner bottle 6 is positioned at two points and attached to the main body 100. The waste toner bottle 6 includes on its upper face an intake opening 32 that is connected to a discharge opening 31 that is formed on the connecting unit 5. A sealing member 11 that is made of, for example, sponge, is arranged around the intake opening 32. While the waste toner bottle 6 is being set, the sealing member 11 is in contact with the discharge opening 31 even before the waste toner bottle 6 is positioned. The agitating gear 9 is projecting from a lateral face of the waste toner bottle 6 so that, when the waste toner bottle 6 is finally set, the agitating gear 9 is engaged with the main body gear 10.

The waste toner bottle 6 further includes, on the face where the intake opening 32 is present, two regulating members 41 that are made of rail-like members, and arranged in parallel along an attachment direction in which the waste toner bottle 6 is attached to the main body 100. A first guide member 42 that is configured to fit between the regulating members 41 is provided on one of two side plates 51 on both sides of the intermediate transfer unit 101. With this arrangement, before the connecting unit 5 comes in contact with the sealing member 11, the first guide member 42 is fitted between the regulating members 41, so that the position of the waste toner bottle 6 is regulated in a direction perpendicular to the attachment direction.

Thus, according to the first embodiment, problems such as deformation of the sealing member 11 do not arise. Consequently, it is possible to prevent a decrease in the sealing ability of the sealing member 11 and waste toner clogging.

Moreover, because the regulating members 41 are arranged on the same face of the waste toner bottle 6 as the intake opening 32 to which the sealing member 11 is attached, it is possible to position the waste toner bottle 6 with respect to the main body 100 with high accuracy. The waste toner bottle 6 is shaped in a flat plate such that the surface horizontal to the attachment direction is large, whereas the surface to the vertical direction is small. Thus, it is easy to attach the regulating members 41 or the like on the upper face on which the intake opening 32 is provided. In addition, it is possible to engage the intake opening 32 and the discharge opening 31 together with high accuracy because the regulating members 41 are positioned near the intake opening 32.

Although the sealing member 11 for preventing toner leakage is explained above as being arranged around the intake opening 32, it can be arranged around the discharge opening 31. In this case, the position of the waste toner bottle 6 is regulated when the first guide member 42 is fitted between the regulating members 41 before the sealing member 11 around the discharge opening 31 comes in contact with the intake opening 32. The sealing member 11 can also be arranged both around the intake opening 32 and around the discharge opening 31. In this case, the position of the waste toner bottle 6 is regulated when the first guide member 42 is fitted between the regulating members 41 before the sealing member 11 around the discharge opening 31 comes in contact with the sealing member 11 around the intake opening 32. Incidentally, the sealing member 11 is not necessarily required. In this case, the position of the waste toner bottle 6 is regulated when the first guide member 42 is fitted between the regulating members 41 before the discharge opening 31 comes in contact with the intake opening 32.

Figure 4A:
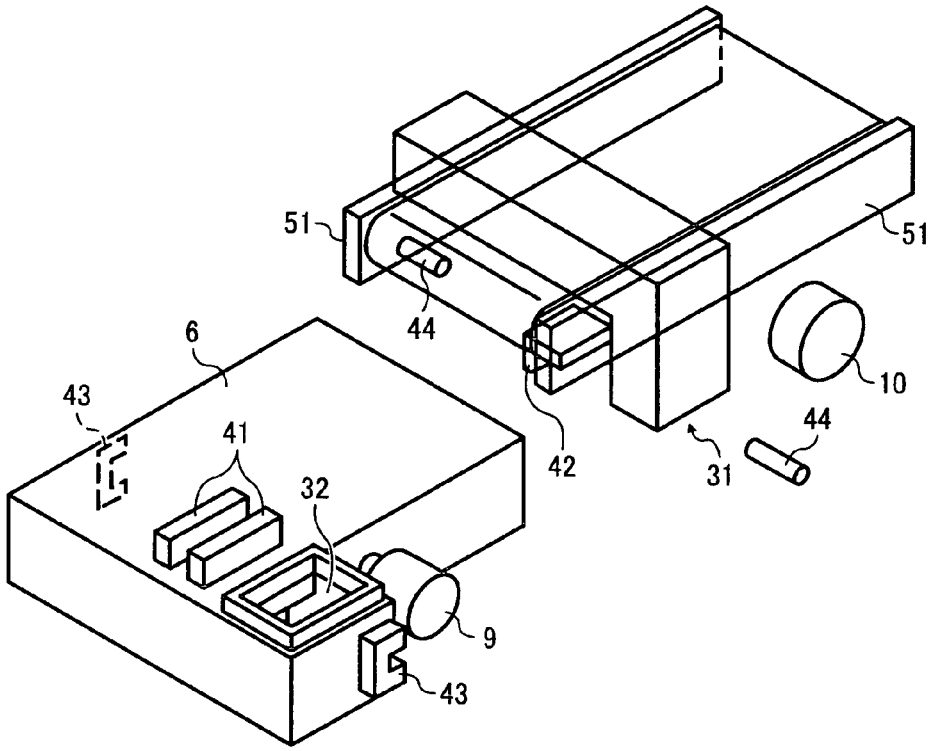
FIGS. 4A and 4B are perspective views of a waste toner bottle attached to an image forming apparatus according to a second embodiment of the present invention.
Figure 4B:
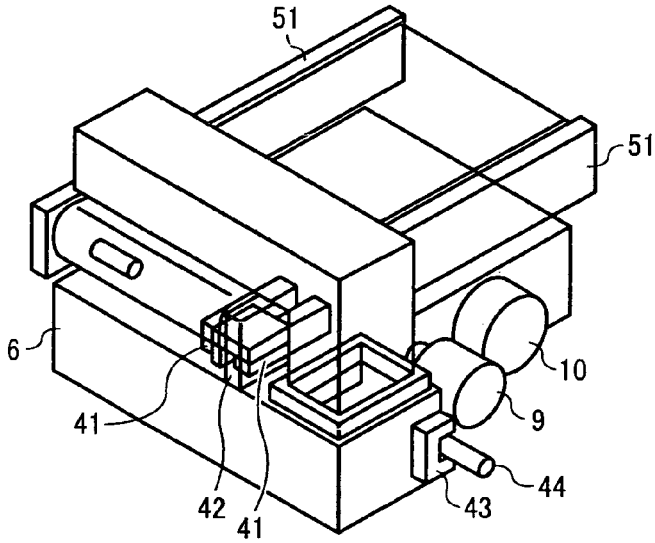

FIGS. 4A and 4B are schematic diagram of an image forming apparatus according to a second embodiment of the present invention. FIG. 4A is a perspective view of the waste toner bottle 6 to be attached to the image forming apparatus. FIG. 4B is a perspective view of the waste toner bottle 6 attached to the image forming apparatus.

The image forming apparatus of the second embodiment includes, in addition to the regulating members 41 and the first guide member 42, a positioning member 43 on both sides of the waste toner bottle 6. Also, second guide members 44 that are respectively engaged with the positioning members 43 are provided on the main body 100. The second guide members 44 are stick-shaped. The positioning members 43 each have a concave portion in which the corresponding one of the second guide members 44 can be fitted. When the waste toner bottle 6 is attached to the main body 100, first, the regulating members 41 are guided by the first guide member 42, so that the position of the waste toner bottle 6 is determined in a direction perpendicular to the attachment direction. Next, the second guide members 44 come into contact and engage with the positioning members 43 so that the position of the waste toner bottle 6 is determined with respect to the main body 100 in the attachment direction. With this, the agitation gear 9 and the main body gear 10 are engaged with each other with high accuracy.

Figure 5A:
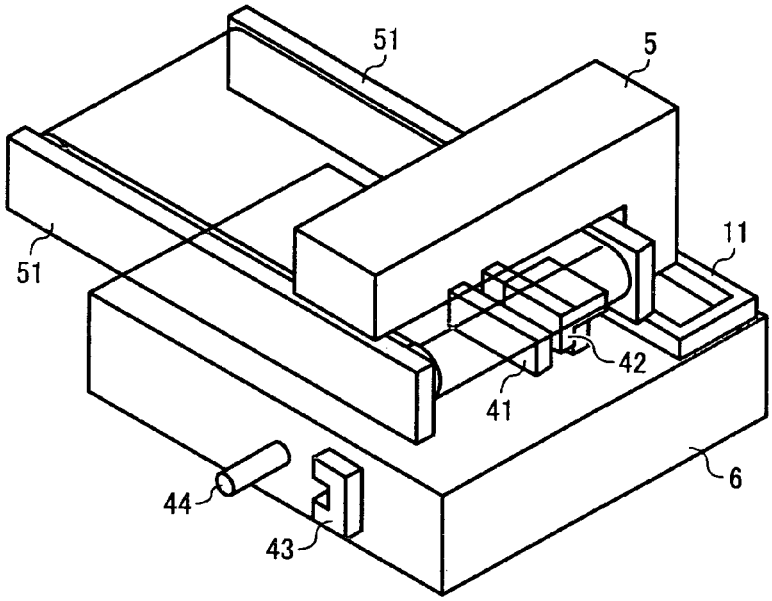
FIGS. 5A and 5B are perspective views of a waste toner bottle attached to an image forming apparatus according to a second embodiment of the present invention.
Figure 5B:
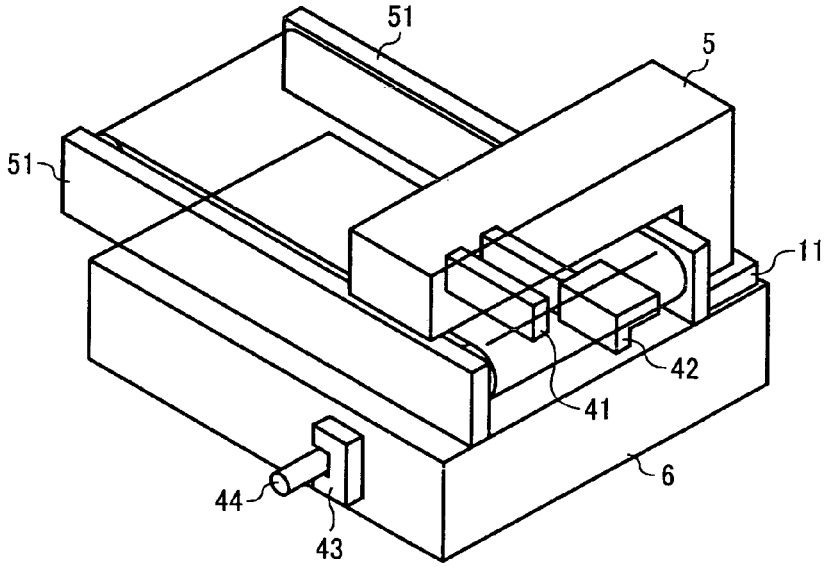

FIGS. 5A and 5B are schematic diagram of an image forming apparatus according to a third embodiment of the present invention. FIG. 5A is a perspective view of the waste toner bottle 6 to be attached to the image forming apparatus. FIG. 5B is a perspective view of the waste toner bottle 6 attached to the image forming apparatus.

According to the third embodiment, the length of the regulating members 41 in the longitudinal direction is short. As a result, engagement between the regulating members 41 and the first guide member 42 is released before each of the positioning members 43 comes engaged with the corresponding one of the second guide members 44.

That is, the positioning operation performed by the regulating members 41 and the first guide member 42 is not concurrent with that performed by the positioning members 43 and the second guide members 44. Consequently, it is possible to prevent the members from interfering with each other when the waste toner bottle 6 is positioned at the plurality of points. This prevents the waste toner bottle 6 from improperly being attached to and detached from the image forming apparatus.

Figure 6:
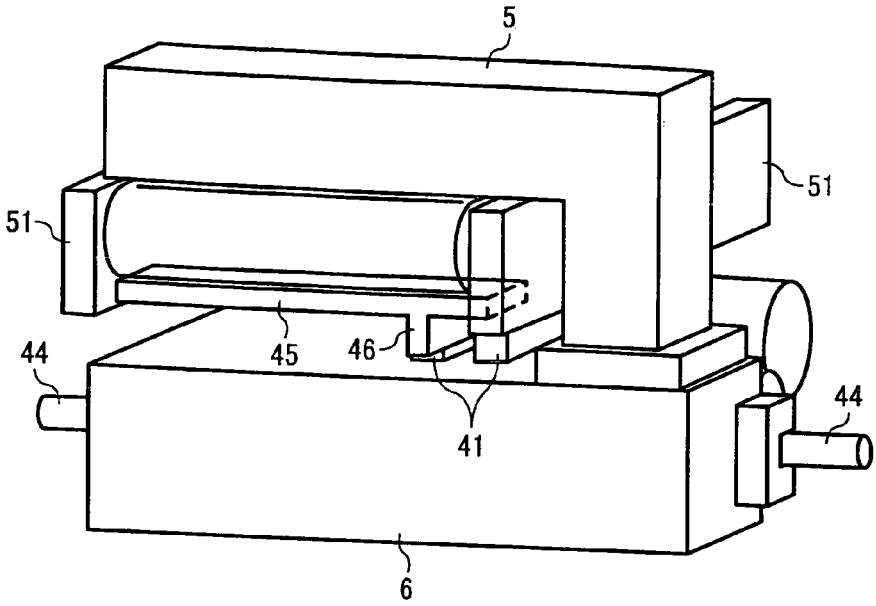
FIG. 6 is a perspective view of an image forming apparatus according to a fourth embodiment of the present invention.

FIG. 6 is a perspective view of an image forming apparatus according to a fourth embodiment of the present invention. The image forming apparatus of the fourth embodiment includes the regulating members 41, the positioning members 43, and the second guide members 44 as with that of the third embodiment, and in addition, a guide member 46 that is engaged with the regulating members 41. The guide member 46 is integrally formed with a holding member 45 that bridges the side plates 51 that support the intermediate transfer unit 101. With this arrangement, it is possible to enhance the strength of the structure of the intermediate transfer unit 101. It is also possible to protect the intermediate transfer belt 1.

Figure 7:
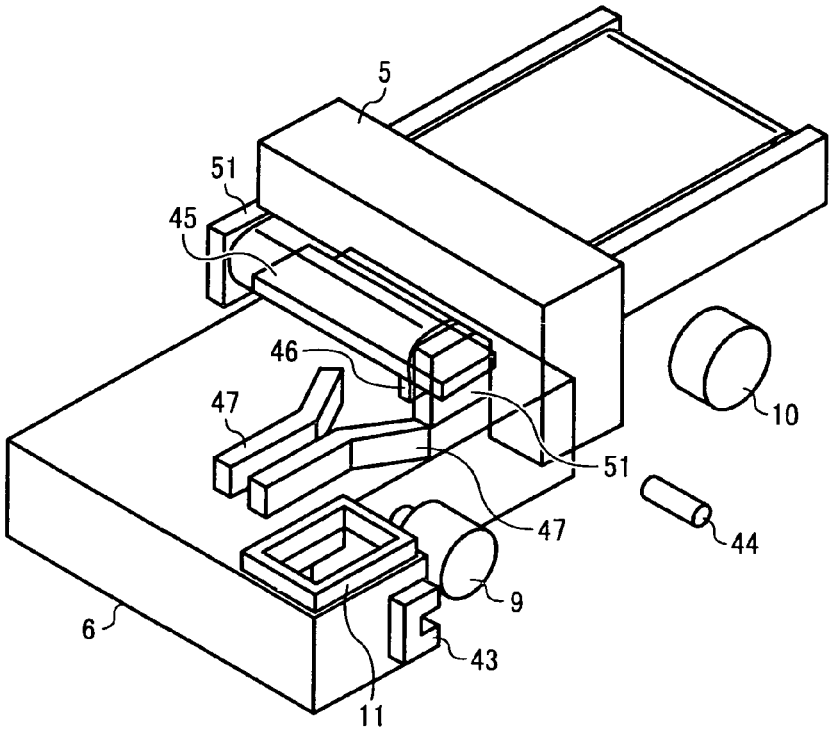
FIG. 7 is a perspective view of an image forming apparatus according to a fifth embodiment of the present invention.

FIG. 7 is a perspective view of an image forming apparatus according to a fifth embodiment of the present invention. The image forming apparatus of the fifth embodiment includes the guide member 46, the positioning members 43, and the second guide members 44 as with that of the fourth embodiment, and in addition, two regulating members 47 of which the distance therebetween is widened toward the guide member 46. In other words, a bending process has been applied to the regulating members 47 so that the distance between them becomes larger toward the back of the waste toner bottle 6 ("back" refers to a side away from the intake opening 32). With this arrangement, when the waste toner bottle 6 is attached to the main body 100, the guide member 46 can be smoothly inserted between the regulating members 47.

In the fifth embodiment described above, the regulating members 47 are provided on the waste toner bottle 6, while the guide member 46 is provided on the main body 100 of the image forming apparatus, so that the guide member 46 is fitted between the regulating members 47. However, another arrangement is acceptable. For example, the regulating members 47 can be provided on the main body 100, while the guide member 46 can be provided on the waste toner bottle 6. In this case, the direction toward which the distance between the regulating members 47 is widened is opposite. In addition, it is acceptable to modify, as necessary, the shapes of the guide member 46 and the regulating members 47. It is also acceptable to modify, as necessary, the shapes of the second guide members 44 on both sides of the waste toner bottle 6 and the shape of the positioning members 43 on both sides of the main body 100.

As set forth hereinabove, according to an embodiment of the present invention, a waste toner container can be easily positioned with respect to an image forming apparatus at a plurality of points with high accuracy.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device, comprising:

a transfer unit that includes a transfer member that transfers a toner image onto a transfer-receiving member;

a cleaning unit that removes waste toner remaining on the transfer-receiving member;

a waste toner container that is configured to be attached to an image forming apparatus, and includes an intake opening through which the waste toner is collected therein;

a connecting member that includes a discharge opening, and is configured to connect between the cleaning unit and the waste toner container to convey the waste toner from the cleaning unit and discharge the waste toner from the discharge opening into the waste toner container through the intake opening, the discharge opening being brought into engagement with the intake opening when the waste toner container is moved toward the connecting member and separating from the intake opening when the waste toner container is moved away from the connecting member; and a regulating unit that regulates a position of the waste toner container with respect to the image forming apparatus in a direction perpendicular to a moving direction of the waste toner container before the discharge opening comes in contact with the intake opening while the waste toner container is moving toward the connecting member, the regulating unit includes:

a regulating member that is arranged on the waste toner container;

a first guide member that guides the regulating member, and is arranged on any one of a main body of the image forming apparatus and the transfer unit;

a positioning member that is arranged on the waste toner container; and a second guide member that engages with the positioning member, wherein the positioning member determines the position of the waste toner container in the moving direction after the regulating unit starts regulating the position of the waste toner container, and wherein the regulating unit stops regulating the position of the waste toner container when the positioning member completes positioning of the waste toner container.

2. The transfer device according to claim 1, wherein the regulating member is located on a surface of the waste toner container on which the intake opening is formed.

3. The transfer device according to claim 1, wherein the first guide member is arranged on a holding member that is located below the transfer-receiving member and extends in a width direction of the transfer-receiving member to hold the transfer-receiving member.

4. The transfer device according to claim 3, wherein the first guide member is integrally formed with the holding member.

5. The transfer device according to claim 1, wherein any one of the regulating member and the guide members is a convex-shaped member, and another one of the regulating member and the guide members is a concave-shaped member, and the concave-shaped member has a tapered portion to receive the convex-shaped member when the waste toner container is attached to the image forming apparatus.

6. The transfer device according to claim 5, wherein the tapered portion of the regulating members is located on a forward side of the intake opening in an attachment direction in which the waste toner container is inserted or attached, and a distance between the regulating members becomes larger toward the attachment direction.

7. The transfer device according to claim 1, further comprising a sealing member arranged around the intake opening.

8. The transfer device according to claim 1, further comprising a sealing member arranged around the discharge opening.

9. The transfer device according to claim 1, further comprising a sealing member arranged around the intake opening and the discharge opening.

10. The transfer device according to claim 1, wherein the regulating member is composed of two regulating members.

11. The transfer device according to claim 10, wherein the regulating members are rail-like members, and arranged in parallel along an attachment direction in which the waste toner container is attached to the main body.

12. The transfer device according to claim 10, wherein the first guide member arranged on the main body is configured to fit between the regulating members so that the position of the waste toner container is regulated in a direction perpendicular to the attachment direction.

13. The transfer device according to claim 1, wherein the positioning member is arranged on both sides of the waste toner container; and and the second guide member is arranged on both sides of the main body.

14. The transfer device according to claim 13, wherein the second guide member is stick-shaped to engage the positioning member having a concave portion in which one of the corresponding second guide members can be fitted.

15. The transfer device according to claim 13, wherein when the waste toner container comes closer to the main body, the regulating members are guided by the first guide member in a direction perpendicular to the attachment direction, and then the second guide members comes into contact and engage with the positioning members so that the position of the waste toner container is determined with respect to the main body in the attachment direction.

16. An image forming apparatus that includes a transfer device, comprising:

a transfer member that transfers a toner image onto a transfer-receiving member;

a cleaning unit that removes waste toner remaining on the transfer-receiving member;

a waste toner container that is detachable, and includes an intake opening through which the waste toner is collected therein;

a connecting member that includes a discharge opening, and is configured to connect between the cleaning unit and the waste toner container to convey the waste toner from the cleaning unit and discharge the waste toner from the discharge opening into the waste toner container through the intake opening, the discharge opening being brought into engagement with the intake opening when the waste toner container is moved toward the connecting member and separating from the intake opening when the waste toner container is moved away from the connecting member; and a regulating unit that regulates a position of the waste toner container in a direction perpendicular to a moving direction of the waste toner container before the discharge opening comes in contact with the intake opening while the waste toner container is moving toward the connecting member, the regulating unit includes:

a regulating member that is arranged on the waste toner container;

a first guide member that guides the regulating member, and is arranged on any one of a main body of the image forming apparatus and the transfer unit;

a positioning member that is arranged on the waste toner container; and a second guide member that engages with the positioning member, wherein the positioning member determines the position of the waste toner container in the moving direction after the regulating unit starts regulating the position of the waste toner container, and wherein the regulating unit stops regulating the position of the waste toner container when the positioning member completes positioning of the waste toner container.

17. A waste toner container that is configured to be detachably attached to an image forming apparatus that includes a transfer member that transfers a toner image onto a transfer-receiving member, a cleaning unit that removes waste toner remaining on the transfer-receiving member, and a connecting member that includes a discharge opening and conveys the waste toner from the cleaning unit, the waste toner container comprising:

an intake opening that is configured to engage the discharge opening for collecting the waste toner conveyed through the connecting member and discharged from the discharge opening, the intake opening being brought into engagement with the discharge opening when the waste toner container is moved toward the connecting member and separating from the discharge opening when the waste toner container is moved away from the connecting member; and a regulating unit that regulates a position of the waste toner container with respect to the image forming apparatus in a direction perpendicular to a moving direction of the waste toner container before the discharge opening comes in contact with the intake opening while the waste toner container is moving toward the connecting member, the regulating unit includes:

a regulating member that is arranged on the waste toner container;

a first guide member that guides the regulating member, and is arranged on any one of a main body of the image forming apparatus and the transfer unit;

a positioning member that is arranged on the waste toner container; and a second guide member that engages with the positioning member, wherein the positioning member determines the position of the waste toner container in the moving direction after the regulating unit starts regulating the position of the waste toner container, and wherein the regulating unit stops regulating the position of the waste toner container when the positioning member completes positioning of the waste toner container.

* * * * *